United States Patent [19]

Gray

[11] 4,304,102

[45] Dec. 8, 1981

[54] REFRIGERATION PURGING SYSTEM

[75] Inventor: Kenneth P. Gray, East Syracuse, N.Y.

[73] Assignee: Carrier Corporation, Syracuse, N.Y.

[21] Appl. No.: 144,139

[22] Filed: Apr. 28, 1980

[51] Int. Cl.[3] ..... F25B 43/04

[52] U.S. Cl. ..... 62/195; 62/85; 62/475

[58] Field of Search ..... 62/85, 475, 149, 292, 62/174, 195

[56] References Cited

U.S. PATENT DOCUMENTS 3,145,544 8/1964 Weller ..... 62/85 X 4,169,356 10/1979 Kingham ..... 62/85

*Primary Examiner*—William E. Wayner

*Assistant Examiner*—Harry Tanner

*Attorney, Agent, or Firm*—J. Raymond Curtin; Donald F. Daley

[57] ABSTRACT

A refrigeration purging system for the removal of non-condensible gases such as air and condensible contaminants such as water is disclosed. A portion of the refrigerant in the refrigeration system is placed in a first purge chamber which condenses the refrigerant and condensible contaminants such as water leaving non-condensibles such as air and a small portion of the refrigerant at the top of the chamber. The non-condensibles and remaining refrigerant is extracted from the first chamber pumped to a higher pressure and passed to a second purged chamber wherein the remaining refrigerant is condensed and returned to the first purged chamber. The non-condensible gases remaining are released to the atmosphere. The condensible contaminants are extracted from the first purged chamber and the condensed refrigerant is returned to the refrigeration system. A control system for regulating the operation of the pump in relation to the amount of non-condensible gases in the first purged chamber is disclosed together with means to control the flow of condensed refrigerant between the two purged chambers.

3 Claims, 2 Drawing Figures

REFRIGERATION PURGING SYSTEM

BACKGROUND OF THE INVENTION

1. Field of the Invention

This invention relates to a refrigeration purging system and process and in particular to a system designed to remove non-condensibles and contaminants which collect within the refrigeration system.

2. Description of the Prior Art

Within refrigeration systems various non-condensible gases and contaminants become mixed with the refrigerant and tend to collect at some point such as the top of the condenser. The presence of non-condensibles and contaminants in the system reduces the efficiency of the system since they necessitate higher condenser pressures with accompanying increases in power cost and cooling water consumption. The capacity of the system is also reduced since the non-condensible gases displace refrigerant vapor. Purging devices of various types have been used to remove or purge the non-condensibles and contaminants from the system.

Such devices normally include a purge chamber for collecting the non-condensibles, such as air and other non-condensible gases, and expelling them to the atmosphere. The gases which collect in the purge chamber also include water vapor and portions of the refrigerant vapor. A heat transfer coil located within the purge chamber is supplied with a cold water or cool liquid refrigerant and operates as a condensing coil to condense the refrigerant and water vapor to a liquid. The condensible gaseous constituents such as refrigerant and water are removed from the chamber and then recirculated to the refrigeration system or expelled from the system. The non-condensible gases are usually vented to the atmosphere by a pump which operates in response to the pressure differential between the purge chamber and the refrigerant condenser. In purge systems of the above-described type, a certain amount of refrigerant which is not condensed within the purge chamber is exhausted to the atmosphere together with the non-condensibles. The evacuated gases contain, on the average, one part of non-condensibles and three parts of refrigerant. It is desirable to significantly reduce the refrigerant expelled during the purging operation since refrigerant is expensive to replace and is an undesirable contaminant in the environment.

SUMMARY OF THE INVENTION

It is an object of this invention to provide a purging system for the efficient withdrawal of non-condensible gases from refrigeration systems without substantial loss of refrigerant.

Another object of this invention is to improve automatically operating purging system for the removal of non-condensible gases from refrigeration systems.

Still another object of this invention is to improve refrigeration purging systems wherein it is possible to improve the purging action by increasing the condensing pressure of the gases collected in the purging chamber to further condense the refrigerant.

These and other objects of this invention are attained by provision of a secondary purge chamber having a cooling coil located therein and adapted to receive the remaining portion of refrigerant and non-condensibles from the main purge chamber and to further condense the refrigerant. Pumping means are arranged in a conduit connecting the main purge chamber to the secondary purge chamber to evacuate the remaining portion of non-condensed refrigerant and non-condensibles from the main purge chamber and direct them to the secondary purge chamber. The pumping means are activated by a pressure actuating means in response to a predetermined pressure differential between the main purge chamber and the refrigerant condenser.

DESCRIPTION OF THE PREFERRED EMBODIMENT

Figure 1:
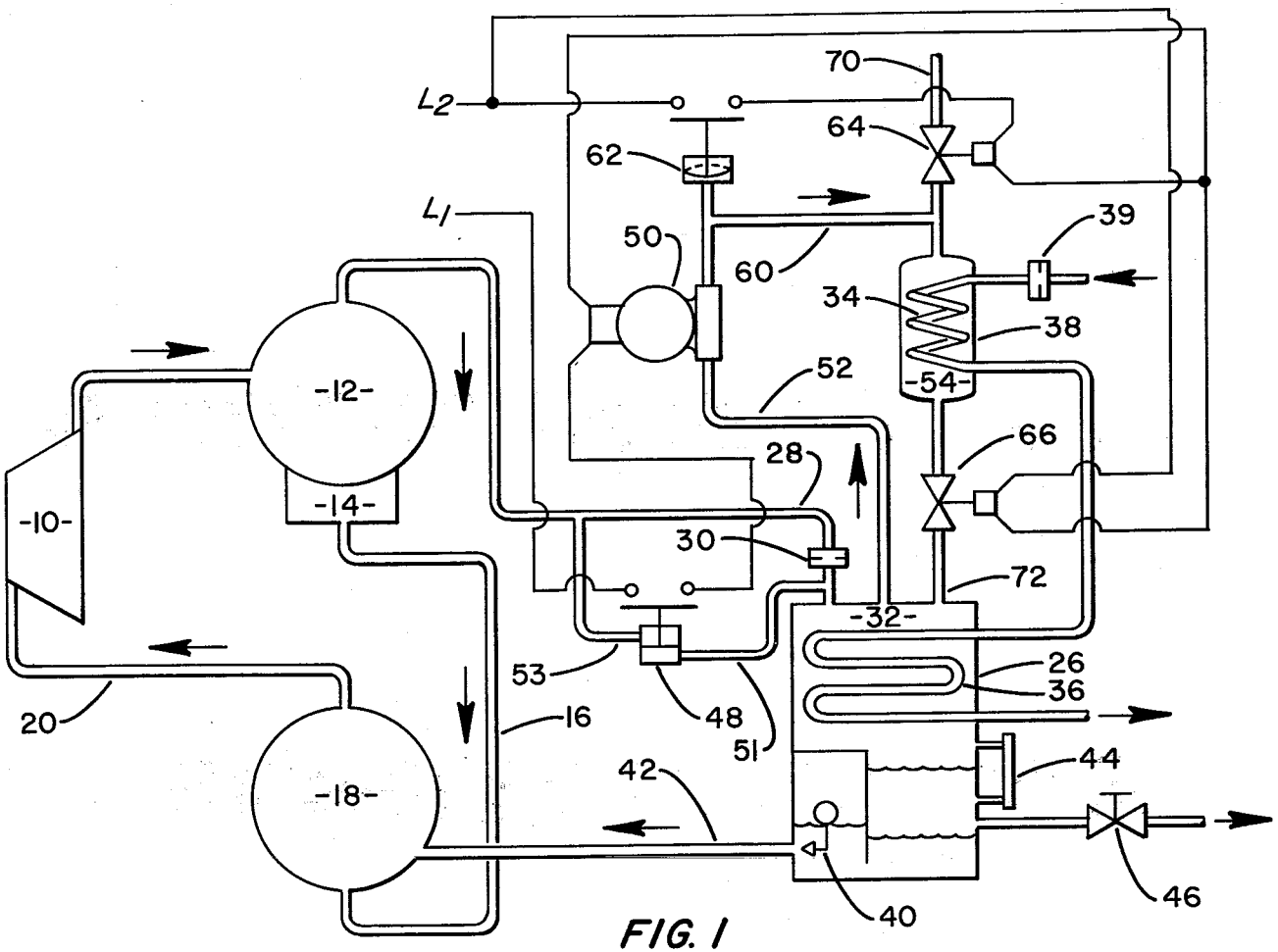
FIG. 1 is a schematic representation of a purging system embodying the present invention and adapted for use in a refrigeration system.

Referring to FIG. 1, a typical refrigeration system is shown in which refrigerant is compressed by a compressor 10. A condenser 12 is provided with a float chamber 14 which supplies liquid refrigerant to a conduit 16 to connect the condenser outlet and the inlet of an evaporator 18. Evaporated refrigerant is discharged from the evaporator 18 through a conduit line 20 to the suction of the compressor 10.

Various non-condensible gases and contaminants become mixed with the refrigerant within the refrigeration system and normally accumulate at the upper part of the condenser 12. In order to purge the system without losing refrigerant, it is necessary to separate the non-condensibles and contaminants from the refrigerant. A main purge chamber 26 is provided for this purpose. The purge chamber 26 is connected with the upper part of the condenser 12 by a conduit line 28 for extracting the gaseous mixture from the condenser and conveying it to the purge chamber.

The vapor entering the purge chamber 26 will normally be a mixture of non-condensible gases, refrigerant vapor and water vapor. Conduit line 28 has an orifice 30 to regulate the flow of vapor between the condenser and the purge chamber. A condensing coil 36 is located in the top portion of the purge chamber 26 to receive cool liquid and condense the refrigerant vapors. A secondary purge chamber 38 is provided in the system having a second condensing coil 34. The condensing coil 34 may be connected with the condensing coil 36 in the main purge chamber so that the same liquid coolant may flow through both coils. Coil 34 receives cool fluid from either an external water supply or from the evaporator 18 or from a separate refrigeration system. An orifice 39 is provided in the line to coil 34 to reduce the refrigerant pressure when liquid refrigerant is supplied from evaporator 18 or from a separate refrigeration system.

In the main purge chamber 26 cold liquid entering the coil 36 is circulated through the coil to drop the temperatures of the vaporous mixture of refrigerant, non-condensibles and contaminants collected in purge chamber 26. As the temperature around the coil 36 is decreased, the refrigerant in the main purge chamber will be condensed. In operation, the refrigerant gas is condensed continuously and falls to the bottom of the purge chamber 26. Light foreign condensibles such as water collect as a layer on top of the relatively pure liquid refrigerant. Arranged within the purge chamber 26 is a conventional float valve 40 to control the level of liquid refrigerant. As the liquid level rises in the chamber the float valve automatically opens to discharge pure liquid refrigerant from the chamber to the evaporator through line 42. As the liquid level drops below a predetermined level, the float valve closes. A side wall of the purge chamber is provided with a sight glass 44 which permits one to determine by visual observation the level of water within the chamber. A manual valve 46 is arranged on the side wall of the chamber to drain off the accumulated water. The non-condensibles, such as air, and the remaining portion of the refrigerant which was not condensed in the purge chamber 26 collects in the upper part of the main purge chamber. As the non-condensible gases accumulate the pressure in the chamber rises approaching the pressure of the vapor and gas from the condenser. In order to expell the non-condensibles and the remaining portion of gaseous refrigerant a pump 50 is provided in the system connected with the purge chamber 26 by a line 52. The motor of the pump 50 is located in an electrical circuit which includes control means containing a differential pressure switch 48, a pressure switch 62, an exhaust solenoid valve 64 and a drain solenoid valve 66. The pressure differential switch 48 has normally open contacts which close when the pressure in purge chamber 26, as measured by a sampling line 51 from the switch to the main purge chamber, approaches the pressure in the line 28, ahead of the orifice 30. The pressure in line 28 is measured by a sampling line 53 which extends between the switch 48 and line 28 ahead of the orifice 30. When the contacts of the switch 48 close the electrical control circuit energizes pump 50.

During the condensing operation in the purge chamber, the substantial amount of condensible constituents of the gaseous mixture entering the purge chamber are liquified and separated from the mixture. However, that portion of the gaseous mixture which remains in the purge chamber still contains an amount of refrigerant which has not been condensed.

In order to reduce the losses of refrigerant during the purge operation the secondary purge chamber 54 is arranged in the system. Pump 50 is connected to an inlet of a shell 38 of the secondary purge 54 chamber by a conduit line 60. A conventional pressure switch 62 is arranged in the conduit line 60 between pump 50 and the inlet of purge chamber 38, and a conventional solenoid valve 64 is provided between purge chamber 38 and a discharge line 70 leading to the atmosphere. As can be seen in FIG. 1, the solenoid portion of valve 64 is connected in the electrical circuit with pressure switch 62. A normally open drain solenoid 66 is located in a conduit line 72 connecting the outlet of purge chamber 38 with main purge chamber 26.

In operation, high pressure vapor from the condenser is introduced to the main purge chamber 26 through line 28 wherein it is cooled by the heat exchange coil 36. Condensible constituents of the entering gas are liquified, collected at the bottom of the purge chamber 26 and drained out of the purge chamber back to the refrigeration system through line 42 by operation of float valve 40. Water which has been condensed from the entering vapor accumulates in the bottom of the purge chamber and is drained off by manual valve 46. The non-condensible gases and that portion of condensible refrigerant which has not condensed in the purge chamber 26 collects at the top of the chamber. As non-condensible gases build up in the main purge chamber, there is less refrigerant vapor being condensed and less pressure drop across the orifice 30. When the non-condensibles have accumulated to the point where the pressure differential between the purge chamber and the line ahead of orifice 30 is insufficient to hold the pressure differential switch 48 open, the switch contacts close and pump 60 is activated and valve 66 is closed. The pump 50 pumps the remaining portion of the refrigerant and non-condensibles accumulated in the top of the purge chamber, through conduit line 52, pump 50 to line 60 and to compress them to a higher pressure into the shell 54. As the gaseous mixture is pumped into line 60, the pressure of gases will be increased. The coolant flowing through the coil 34, will absorb heat from the gaseous mixture and a portion of the condensible refrigerant which was not condensed in purge chamber 26 will be condensed in the purge chamber 54 and collect at the bottom of the chamber. Since the condensing pressure is higher in the purge chamber 54 than in the purge chamber 26 and the temperature of coil 34 is lower than coil 36 more refrigerant is condensed from the vapor and less refrigerant goes to the atmosphere when the non-condensed portion is purged from the chamber. As the refrigerant and non-condensibles are pumped into conduit line 60, pressure switch 62, which can be set to operate at any given pressure closes, when a predetermined pressure is reached in the line 60. The closed contacts of the switch 62 energize solenoid valve opening the valve 64 and permitting non-condensed vapor to exhaust to the atmosphere through line 70. As non-condensibles and non-condensed refrigerant are evacuated from purge chamber 26, pressure in the purge chamber drops and pressure differential switch 48 opens. The purge cycle is completed. At this time, the pump stops and drain solenoid valve 66 opens permitting the condensate to flow out of the purge chamber 38 through line 72 to the purge chamber 26. The condensate from chamber 54 is mixed with the refrigerant condensed in the purge chamber 26 and is returned to the refrigeration system.

Figure 2:
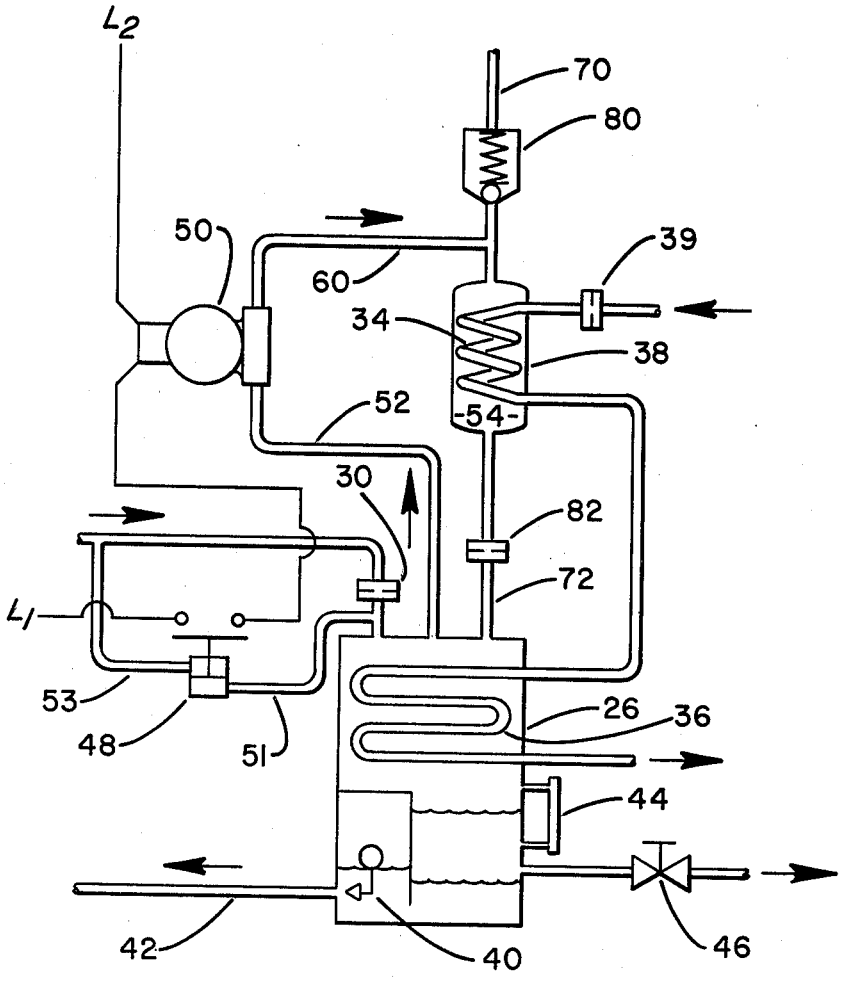
FIG. 2 is a partial schematic view of a modified form of purging unit shown in FIG. 1.

A second embodiment of the invention is illustrated in FIG. 2 and involves a simplification of the means for removing the non-condensibles from the purge chamber 54 and means for connecting the outlet of purge chamber 54 with purge chamber 26. In the form of the invention illustrated in FIG. 2, a pressure relief valve 80 is employed in place of exhaust solenoid valve 64. The valve 80 is responsive to pressure in line 60 such that it opens upon a rise of pressure above a preset value and closes upon a decrease of pressure below the preset value. When the pressure in the line 60 exceeds the set value of relief valve 80 the latter opens and allows the non-condensibles to flow from the upper portion of shell 38 through line 70 to the atmosphere. The relief valve will remain open until pressure in line 60 drops. In addition, an orifice 82 is arranged in line 72 in place of drain solenoid valve 66 shown in FIG. 1. Orifice 82 is small enough to maintain pressure in the purge chamber 54 and to allow liquid refrigerant condensed in purge chamber 54, to flow from shell 38 to the purge chamber 26.

It is recognized that variations and changes from the embodiments illustrated and described herein may be made without departing from the invention as set forth in the claims.

I claim:

1. A purge system for removing non-condensible vapors from a refrigeration system including a first purge chamber having a first condensing coil therein, a second purge chamber having a second condensing coil therein, means to supply refrigerant vapor and non-condensible gases from the refrigeration system to the first purge chamber, means to pump refrigerant vapors and non-condensible gases from the first purge chamber into the second purge chamber at a selected higher pressure than the vapor in the first purge chamber, means to initiate the means to pump refrigerant vapors and non-condensible gases to the second purge chamber in response to a rise in pressure in the first purge chamber, means to exhaust non-condensible gases from the second purge chamber, conduit means for returning condensed refrigerant from the second purge chamber to the first purge chamber, valve means for automatically restricting the fluid flow through the conduit means from the second purge chamber to the first purge chamber when the pressure in the first purge chamber is above a predetermined limit and automatically returning condensed refrigerant from the second purge chamber to the first purge chamber when the pressure in the first purge chamber is below the predetermined limit, and means to return condensed refrigerant from the first purge chamber to the refrigeration system.

2. The purge system of claim 1 wherein the valve means is a solenoid operated valve responsive to changes in pressure in the first purge chamber.

3. The purge system as recited in claim 1 wherein the first and second purge chambers have their condensing coils connected to provide a single circuit for the flow of a heat transfer fluid wherein the fluid flows first through the second condensing coil and then through the first condensing coil.

* * * * *